US006216285B1

(12) United States Patent
Olin

(10) Patent No.: US 6,216,285 B1
(45) Date of Patent: Apr. 17, 2001

(54) WASTE TRANSPORT ARRANGEMENT

(75) Inventor: Henry Olin, Espoo (FI)

(73) Assignee: Evac International Oy, Helsinki (FI)

( * ) Notice: Subject to any disclaimer, the term of this patent is extended or adjusted under 35 U.S.C. 154(b) by 0 days.

(21) Appl. No.: 09/470,717

(22) Filed: Dec. 23, 1999

(30) Foreign Application Priority Data

Dec. 23, 1998 (FI) ..... 982785

(51) Int. Cl.[7] ..... E03D 11/00
(52) U.S. Cl. ..... 4/431; 4/321; 4/323; 4/434
(58) Field of Search ..... 4/316, 431–434, 4/DIG. 9, 321, 323, 474, 475; 137/205

(56) References Cited

U.S. PATENT DOCUMENTS

| | | | | |
|---|---|---|---|---|
| 3,629,099 | | 12/1971 | Gahmberg et al. | 210/104 |
| 4,034,421 | | 7/1977 | Pihl et al. | 4/10 |
| 4,184,506 | | 1/1980 | Varis et al. | 137/205 |
| 4,246,925 | | 1/1981 | Oldfelt | 137/205 |
| 4,713,847 | | 12/1987 | Oldfelt et al. | 4/316 |
| 4,819,279 | * | 4/1989 | Sigler et al. | 4/321 |
| 5,133,853 | | 7/1992 | Mattsson et al. | 210/104 |
| 5,396,668 | * | 3/1995 | Haatanen | 4/431 |

* cited by examiner

*Primary Examiner*—Gregory L. Huson
*Assistant Examiner*—Tuan Nguyen
(74) *Attorney, Agent, or Firm*—Marshall, O'Toole, Gerstein, Murray & Borun

(57) ABSTRACT

A vacuum waste system having reduced noise levels associated therewith. The vacuum waste system includes a sanitary unit for initially receiving waste. An intermediate container is connected to the sanitary unit by a first sewer pipe and a first sewer valve. A receptacle is connected to the intermediate container by a second sewer pipe and a second sewer valve. The system also includes a vacuum pump for generating vacuum in the second sewer pipe, intermediate container, and first sewer pipe. Transfer of waste from the sanitary unit to the receptacle is performed in two stages. In a first stage, the first valve is opened and the second valve is closed so that vacuum transports the waste from the sanitary unit to the intermediate container. In the second stage, the first valve is closed and the second valve is opened to transfer the waste from the intermediate container through the second sewer pipe. A flexible membrane is provided for adjusting the volume of the intermediate container to control the velocity of air entering through the first valve, thereby reducing noise. The flexible membrane increase the volume of the intermediate container during the first stage so that the intermediate container holds a sufficient amount of air at approximately ambient air pressure to perform the second stage.

19 Claims, 2 Drawing Sheets

WASTE TRANSPORT ARRANGEMENT

FIELD OF THE INVENTION

The present invention generally relates to a vacuum sewer system for transporting waste to a collecting container, municipal sewer, or the like.

BACKGROUND OF THE INVENTION

One basic problem with vacuum sewer systems relates to the high noise they produce. The noise occurs when the sewer valve opens and closes and when air is drawn into the open sewer. The vacuum sewer technique requires a relatively great volume of air to rapidly flow into the sewer immediately following the material to be transported. Further, the sewer valve must open and close rapidly. These functions cause considerable noise reducing pressure variations.

Reducing the noise level in a large vacuum sewer system is particularly difficult, because a large system has a greater total volume. As a result, large vacuum sewer systems typically require an intake of large amounts of air.

SUMMARY OF THE INVENTION

An object of the present invention is to create a sewer arrangement that is entirely based on the vacuum sewer technique and is adapted for use in a large vacuum sewer system, in which arrangement the noise level is low and in which the function control is easy to perform. The characteristic features of the invention are stated in the claims. A vacuum sewer system of this kind combines the advantages of the vacuum sewer technique with a low noise level in spite of a large sewer volume.

The invention is based on two observations. First, less noise is produced if lesser amounts of air have to be let into the sewer through a sanitary unit, e.g. a toilet. Secondly, the noise level is reduced, if the average speed of the air stream in question can be lowered during the emptying of a sanitary unit.

According to the invention, the emptying of and the waste transport from a sanitary unit, e.g. a toilet, is made in two stages, both of which take part in a sewer under vacuum. In the first stage, waste transport is performed, as known per se, through a first sewer portion into an intermediate container under vacuum. This makes it possible to keep the transport distance short and the applied volume under vacuum relatively small. Irrespective of the total size of the vacuum sewer system, the first stage of waste transport can be carried out in a system of standard design, which improves functional reliability because a standard system can be trimmed to optimize its functionality. Small-size vacuum sewer devices having this type of initial function are known from U.S. Pat. No. 5,133,853. Their primary weakness lies in the fact that the vacuum induced waste transport ends in the intermediate container. From there on the waste must be transported by pressurized air or by another pressure agent, which would be really troublesome in a large system. According to the invention, the entire waste transport mechanism is based on vacuum sewer technique, and no pressure agent other than ambient air is needed in any transport stage. Consequently, a system according to the invention can be used in large vacuum sewer networks, such as in passenger vessels or hotels. Because of the specific characteristics of the invention, the size of the vacuum network has no negative influence on the noise level.

It is of advantage that a system according to the invention includes means for controlling the first stage of waste transport so that the air flowing into the intermediate container via the sanitary unit raises the pressure in the intermediate container to at least close to the pressure of the ambient air. This reduces the average speed of the air flow, which reduces the noise level. On the other hand, it is suitable to dimension the intermediate container so that, after the first transport stage, it contains a sufficient volume of air to allow the second waste transport stage to be carried out without feeding external air to the intermediate container or to the sewer portion downstream thereof. If no external air feed is needed, the system structure remains fairly uncomplicated and the number of possible leak points is reduced. If the sanitary unit is a toilet, it is recommended that the volume of the intermediate container be at least 4 liters. It should preferably be considerably greater, for instance 10 to 15 liters.

In a preferred embodiment, the downstream end of the first sewer portion is formed in an inverted U-shape which empties into the upper portion of the intermediate container. The downstream end of the first sewer portion should be at a clearly higher level than the surface of the sewage collected in the intermediate container. Thereby, the air volume contained in the intermediate container as well as in the first sewer portion is available in a technically advantageous manner for the second stage of waste transport.

If the first sewer portion is kept fairly short, the waste transport taking part therein causes as little noise as possible. Generally, it is of advantage, that the first sewer portion has a total length, from its sewer valve to its downstream end in the intermediate container, of at the most 3 m, preferably at the most 2 m.

In a vacuum sewer, the transport of material, in particular closely downstream of a sanitary unit, is generally performed most securely in a direction upwards. Hence it is of advantage, if the downstream end of the first sewer portion is at a considerably higher level than its upstream end.

It is of advantage to use the same vacuum level, the so-called "system vacuum" maintained by means of the vacuum generating means of the system, in the first as well as in the second stage of waste transport. This vacuum level preferably sets the absolute pressure in the sewer to about 75 to 30% of the pressure of the ambient air. The best operational reliability is generally achieved if the absolute pressure in the sewer is about 65 to 40% of the pressure of the ambient air.

The efficiency of the first stage of waste transport is improved, if the volume of the intermediate container is made variable and controllable by means of a movable means, for instance a membrane, a piston or the like. The idea is to keep the volume of the intermediate container small at the beginning of the first stage of waste transport and enlarge it at the end of the same stage. This enhances the efficiency of the first stage of waste transport. In an advantageous embodiment, the means controlling the volume of the intermediate container is pressure operated, preferably operated by means of the "system vacuum". Thus, a change of the volume of the intermediate container can be adapted to the first stage of waste transport, so that the volume of the intermediate container is automatically considerably smaller at the beginning of the first stage of transport than at the end of the same stage. It is of advantage to have a time related interconnection between the function of volume control means and the function of the sewer valve. This can be obtained if the volume change is pneumatically controlled through the operational means of the sewer valve. Such a system gives the best prospects for controlling the volume of the intermediate container in a manner best serving the function of the system. At the same time the structure of the control means remains fairly uncomplicated and is based on a control technique already previously used in vacuum sewer systems.

The structure of a system according to the invention can be simplified by arranging the connection of the intermediate container to a second sewer portion through a second sewer valve, having its opening and closing movement functionally connected to the function of the sewer valve of the sanitary unit connected to the first sewer portion. The basic idea is that when one sewer valve opens the other closes and vice versa. Such a functional connection can be easily obtained by arranging the sewer pipes so that both sewer valves are close to one another so that their operating mechanisms can be mechanically interconnected. Alternatively, both sewer portions may be connected to the same disc valve, so that a through-flow opening in the valve disc can take a position in line with one or the other of the two sewer portions.

Reducing the noise level is in practice best obtained by installing the sanitary unit in a room space and the intermediate container outside the wall or any other limiting surface of that room. The limiting surface of the room acts as a noise insulation for the noise produced when filling the intermediate container in the first stage of waste transport and when emptying it in the second stage of waste transport.

BRIEF DESCRIPTION OF THE DRAWINGS

In the following, the invention will be explained more fully with reference to the accompanying schematic drawings, in which.

DETAILED DESCRIPTION OF THE PREFERRED EMBODIMENT

Figure 1:
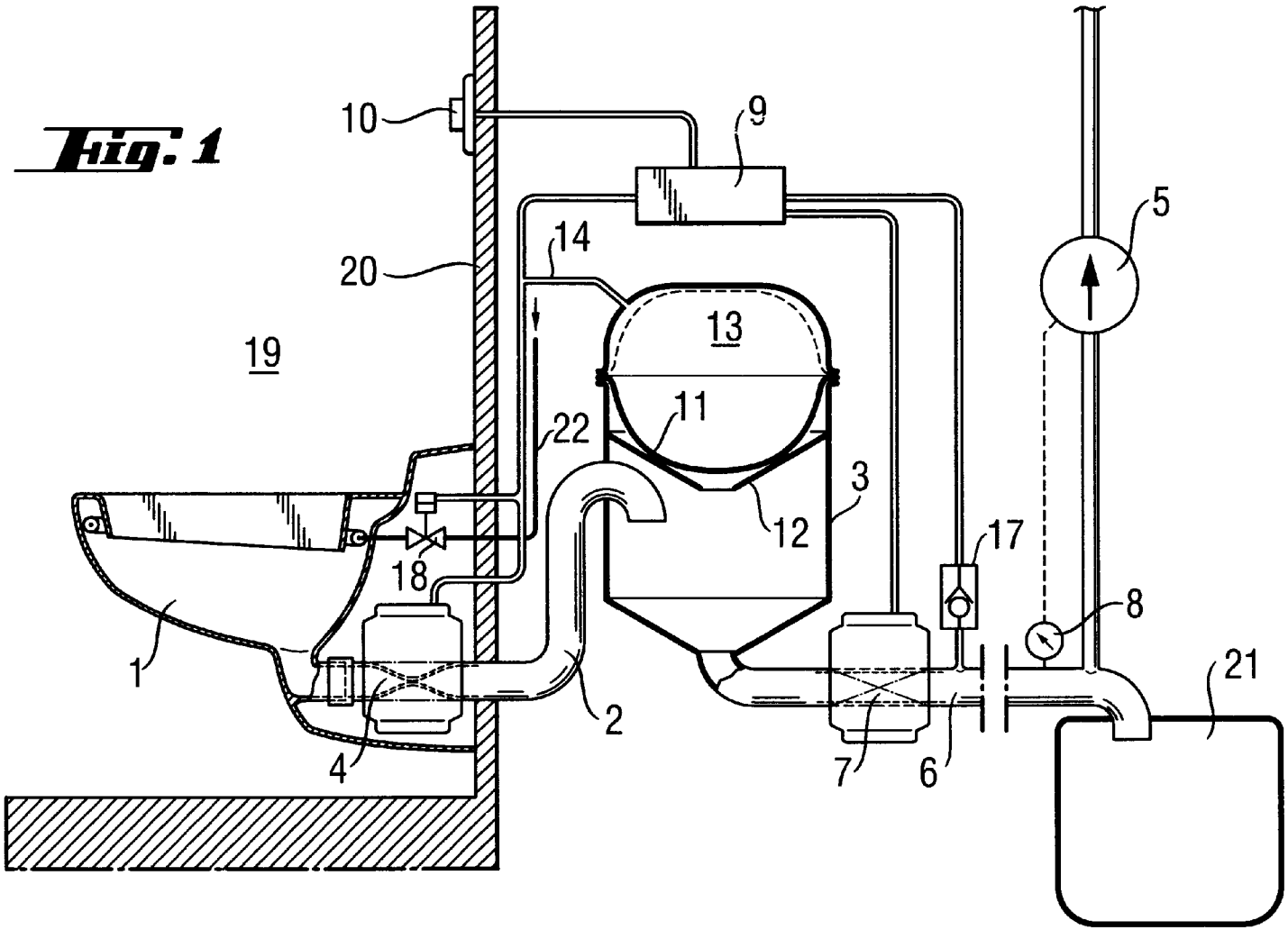
FIG. 1 shows a system according to the invention adopted to serve a toilet.

In the drawings, 1 indicates a vacuum toilet and 2 a first sewer portion connected thereto. The first sewer portion 2 leads to an intermediate container 3. The transport of waste material from the toilet 1 is controlled by means of a sewer valve 4, which normally is kept closed, but which can be opened, if, in the sewer 2, there is a vacuum strong enough for effective transport of toilet waste. The vacuum of the system is generated by a vacuum pump 5.

Another sewer pipe 6 is leading out from the intermediate container 3. This pipe has, at its upstream end, a sewer valve 7 that works in principle in the same manner as the sewer valve 4. When the sewer valve 4 is closed, the sewer valve 7 stays open, but is closed when the sewer valve 4 is to be opened. The sewer pipe 6 leads to a receptacle 21, which may be separated from the pipe 6 by a device (not shown) that allows the receptacle to be under atmospheric pressure in spite of the fact that the vacuum pump continuously maintains, in the pipe 6, a vacuum of about one half of atmospheric pressure. Devices of this kind are known, for instance, from the patent publications U.S. Pat. Nos. 3,629,099, 4,184,506, 4,034,421, and U.S. Pat. No. 4,246,925. As used herein, the word "receptacle" includes any type of destination for the waste, such as a collecting container, as illustrated in FIGS. 1 and 2, or a community sewer line.

Figure 2:
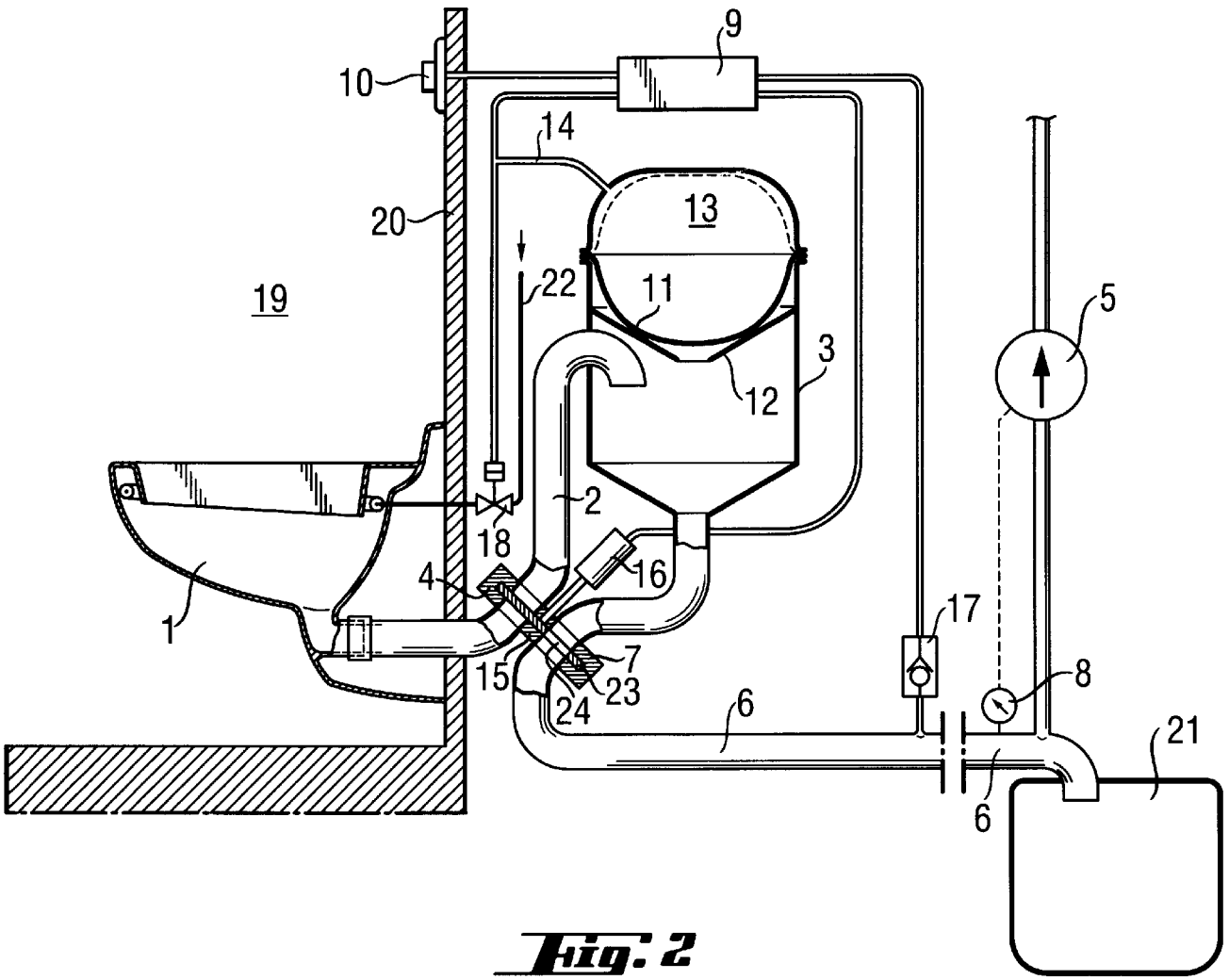
FIG. 2 shows how the two sewer valves of the system of FIG. 1 may be functionally interconnected.

The function of the arrangement shown in FIG. 1 is the following: A pressure sensor controls the vacuum pump 5 so that the pump continuously maintains, in the sewer pipe 6, a vacuum of about one half of atmospheric pressure with some variation between preset upper and lower limits. In the quiescent state of the arrangement this same vacuum prevails also in the intermediate container 3 and in the sewer pipe 2. For emptying the toilet 1 the valve 7 is closed and the valve 4 is opened. Thereby, the pressure of the ambient air rapidly pushes the waste present in the toilet into the sewer pipe 2 and therethrough to the intermediate container 3. The valve 4 is kept open long enough for raising the pressure in the intermediate container 3 to about the level of the pressure of the ambient air, which happens in one or a few seconds. Thereafter, the valve 4 is closed and the valve 7 is opened, whereby, due to the vacuum prevailing in the pipe 6, the air under atmospheric pressure in the intermediate container 3 pushes the waste collected in the intermediate container into the pipe 6. The valve 7 remains open, whereby the vacuum created by the vacuum pump 5 again spreads into the intermediate container 3 and the pipe 2.

The function of the system is controlled by a control device 9, to which the toilet's flush demand push-button 10 is connected. The function of the control device 9 is known per se and is therefore not explained here. The control device 9 may be a device generally used in vacuum sewer systems and sold under the trade name EVAC 90 by Evac International Oy of Helsinki, Finland. Through a check valve 17 this device is connected to a portion of the vacuum sewer that is continuously under vacuum. By pressing the push-button 10 the function of the control device 9 is started. The control device 9 includes means for connecting the different operating devices present to the vacuum source 5 of the system, thereby controlling the function and time of the opening and closing movements of the sewer valves 4 and 7 and of a closure valve 18 of a flush water pipe 22 that is connected to the toilet 1.

The function described can be effected by providing the intermediate container 3 with a device controlling the volume therein. In FIG. 1 such a device has the form of a movable airtight flexible membrane 11 installed in the upper portion of the container 3. When the container 3 is under vacuum, the membrane 11 is in its lower position, pressed by ambient air against a support plate 12. The inner volume of the container 3 is then at a minimum, which in the illustrated embodiment is about 5 to 7 liters. When the sewer valve 4 is opened, the control device 9 connects, through the pipe 14, the space 13 above the membrane 11 of the container 3, which space is also about 5 to 7 liters, to the vacuum source of the system, whereby the membrane 11 takes the position shown in dotted lines, at or close to the interior surface of the upper portion of the container 3. The membrane 11 stays in this position, until the sewer valve 4 has again been closed. In this state, before the opening of the sewer valve 7, the pressure in the container 3 is atmospheric, which keeps the membrane 11 in its upper position, even when the device 9 no longer maintains a vacuum at the upper side of the membrane.

The arrangements described give the following advantages: The volume of the intermediate container 3 is initially small, which means that the amount of air required for transporting waste from the toilet 1 to the container 3 is also relatively small. This supports a reduction of the noise level. When the volume of the container 3 is enlarged by means of moving the membrane 11, additional air flows into the container 3 through the sewer valve 4, but the speed of this flow is relatively low, so that much noise is not produced.

For preventing the waste present in the intermediate container 3 from flowing back into the pipe 2 it is of advantage that the downstream end of the sewer position 2 empties into the upper part of the free inner space of the intermediate container 3, preferably so that the downstream end of the sewer portion 2 is formed with an inverted U-shape, for instance as shown in FIG. 1. The total length of the sewer portion 2 from the valve 4 to the downstream end of the sewer portion is, in the embodiment according to FIG. 1, about 1.5 meters. Of this length, the major part is directed upwards, which is of advantage for obtaining an effective vacuum induced transport of waste material.

In the embodiment shown in FIG. 2, the sewer valves 4 and 7 are arranged in the form of a disc valve. A valve type suitable for this purpose is shown, for instance, in U.S. Pat. No. 4,713,847. The valves 4 and 7 are combined into one valve device 15 connected to the pipe 2 as well as to the pipe 6. In the housing of the valve device 15, there is a rotatable circular valve disc 23 receiving its movement power from an operating device 16. The valve disc 23 may have one through-flow opening 24 that alternatively takes a position in line with the pipe 2 and with the pipe 6, or two through-flow openings, of which one moves away from the position of the pipe 2, when the other moves to the position of the pipe 6 and vice versa. If two through-flow openings are used, it is possible, in the illustrated embodiment, to arrange the movement of the valve body (the disc 23) so that a smaller turning angle of the valve disc 23 is needed than when one through-flow opening is used. This is also possible when there is only one through-flow opening, if the pipes 2, 6 are not diametrically disposed relative to the turning axis of the disc 23, as shown in FIG. 2, but are instead angularly closer to one another. Instead of a rotatable circular valve disc, the valve body may be provided in a variety of different forms, such as a sector plate (which is a disc having only a portion, or sector, less than 360° disposed in the valve), or a linearly moving plate. The operating unit 16 of the combined valve 15 may be provided as a vacuum controlled device, powered by the pressure difference between the "system vacuum" and the ambient air, an electrically powered device, or other arrangement.

The toilet 1 is installed in a room 19. The intermediate container 3 and the control devices connected thereto are preferably located on the other side of a wall 20 of the room 19, thereby to reduce the noise level in the room 19.

The invention is not limited to the embodiments shown, but several modifications thereof are feasible within the scope of the attached claims.

What is claimed is:

1. A vacuum sewer system for periodically transporting waste, the vacuum sewer system comprising:

a sanitary unit for receiving the waste;

an intermediate container connected to the sanitary unit by a first sewer pipe and a first sewer valve, the first sewer valve being normally closed;

a receptacle connected to the intermediate container by a second sewer pipe and a second sewer valve, the second sewer valve being normally open;

means for generating vacuum in the second sewer pipe, intermediate container, and first sewer pipe; and means for controlling operation of the first and second sewer valves thereby to transfer the waste in a first waste transport stage and a second waste transport stage, the control means, in the first waste transport stage, opening the first sewer valve and closing the second sewer valve to transport the waste from the sanitary unit to the intermediate container, the control means, in the second waste transport stage, closing the first sewer valve and opening the second sewer valve to produce vacuum-induced transport of the waste from the intermediate container through the second sewer pipe.

2. A system according claim 1, in which the control means opens the first sewer valve for a sufficient time during the first waste transport stage to increase a pressure in the intermediate container to near atmospheric pressure.

3. A system according to claim 1, in which the intermediate container has a volume to contain, after the first waste transport stage, sufficient air to perform the second waste transport stage.

4. A system according to claim 3, in which the volume of the intermediate container is at least 4 liters.

5. A system according to claim 3, in which the volume of the intermediate container is approximately 10 to 15 liters.

6. A system according to claim 1, in which a downstream end of the first sewer pipe empties into an upper portion of the intermediate container.

7. A system according to claim 1, in which the first sewer pipe has a total length measured from the first sewer valve to a downstream end of the first sewer pipe, and the total length is 3 meters or less.

8. A system according to claim 7, in which the total length of the first sewer pipe is 2 meters or less.

9. A system according to claim 1, in which the first sewer pipe has a downstream end disposed at a considerably higher level than the first sewer valve.

10. A system according to claim 1, in which the vacuum means generates a nominal pressure level of between approximately 75 to 30% of an ambient air pressure.

11. A system according to claim 10, in which the nominal pressure level is approximately 65 to 40% of the ambient air pressure.

12. A system according to claim 1, further comprising means for controlling a volume of the intermediate container.

13. A system according to claim 12, in which the means for controlling the volume of the intermediate container is pressure controlled so that, at a beginning of the first waste transport stage, the volume of the intermediate container is smaller than at an end of the first waste transport stage.

14. A system according to claim 13, in which the vacuum produced by the vacuum generating means controls a pressure of the means for controlling the volume of the intermediate container.

15. A system according to claim 12, in which operation of the means for controlling the volume of the intermediate container is timed with respect to operation of the first sewer valve.

16. A system according to claim 13, further comprising a control device operably connected to the first sewer valve and means for controlling the volume of the intermediate container.

17. A system according to claim 16, in which the control device is pneumatically operated.

18. A system according claim 1, in which the first and second sewer valves are mechanically coupled so that when the first sewer valve opens, the second sewer valve closes, and when the first sewer valve closes, the second sewer valve opens.

19. A system according to claim 1, in which the sanitary unit is located in a room space having a limiting surface, and the intermediate container is located outside the limiting surface.

* * * * *